US008078070B2

(12) United States Patent
Kubo et al.

(10) Patent No.: US 8,078,070 B2
(45) Date of Patent: Dec. 13, 2011

(54) IMAGE FORMING APPARATUS AND CONTROL METHOD THEREOF

(75) Inventors: Hideki Kubo, Kawasaki (JP); Shugo Higuchi, Inagi (JP); Mizue Shimbaru, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 12/371,026

(22) Filed: Feb. 13, 2009

(65) Prior Publication Data

US 2009/0220261 A1 Sep. 3, 2009

(30) Foreign Application Priority Data

Feb. 28, 2008 (JP) ..... 2008-048823

(51) Int. Cl.
*G03G 15/00* (2006.01)

(52) U.S. Cl. ..... 399/49

(58) Field of Classification Search ..... 399/49, 399/53, 72
See application file for complete search history.

(56) References Cited

U.S. PATENT DOCUMENTS

| | | | | |
|---|---|---|---|---|
| 6,081,678 | A * | 6/2000 | Kato | 399/49 |
| 6,418,281 | B1 | 7/2002 | Ohki | 399/49 |
| 6,694,109 | B1 * | 2/2004 | Donaldson et al. | 399/49 |
| 7,236,276 | B2 * | 6/2007 | Nakane et al. | 399/49 X |
| 2005/0169651 | A1 * | 8/2005 | Yamada | 399/49 |
| 2006/0198648 | A1 * | 9/2006 | Itagaki | 399/49 |
| 2007/0230978 | A1 * | 10/2007 | Zaima | 399/49 |
| 2009/0060538 | A1 | 3/2009 | Higuchi et al. | |

FOREIGN PATENT DOCUMENTS

JP 2000-238341 9/2000

* cited by examiner

*Primary Examiner* — Sandra Brase
(74) *Attorney, Agent, or Firm* — Fitzpatrick, Cella, Harper & Scinto

(57) ABSTRACT

An image forming apparatus is provided that uses a table generated in advance to correct a gradation characteristic of an image to be formed when carrying out image forming using an image carrier. A patch is formed in an area where the image is not formed on the image carrier. A density of the patch formed on the image carrier is measured. The table is modified based on the density of the patch that has been measured. The patch is formed concurrently with image forming of the image on the image carrier.

10 Claims, 6 Drawing Sheets

IMAGE FORMING APPARATUS AND CONTROL METHOD THEREOF

BACKGROUND OF THE INVENTION

1. Field of the Invention

The present invention relates to image forming apparatuses and control methods thereof, and particularly relates to image forming apparatuses and control methods thereof in which gradation characteristics of an image are corrected.

2. Description of the Related Art

Conventionally, image forming apparatuses that employ an electrophotographic method (particularly color copiers or laser beam printers or the like that use color toners of a plurality of colors) are provided with lookup tables ("LUTs") for converting image signals to signal values corresponding to characteristics of its image forming engine so as to obtain desired density gradations. In the case of a color copier for example, a LUT is provided for the colors of yellow (Y), magenta (M), cyan (C), and black (K) respectively, and a desired full color image can be output by optimizing the signals of each color using the respective LUT.

Generally, the gradation characteristics of electrophotographic method image forming apparatuses change undesirably due to change over time. Accordingly, in a case where usage of the apparatus will extend over a long period for example, it is preferable that the LUTs for adjusting gradation characteristics held inside the apparatus are regenerated with a timing such as when the apparatus is started (see Japanese Patent Laid-Open No. 2000-238341 for example).

Generally, in creating LUTs for adjusting gradation characteristics in electrophotographic method image forming apparatuses, time is required for creating density measurement patches on an image carrier such as a photosensitive drum, an intermediate transfer member, or a recording paper, and for measuring these patches. Consequently, since it is necessary to generate and measure a very large number of patches to generate LUTs with high accuracy, the time taken in the process of generating LUTs increases undesirably for greater numbers of patches.

The aforementioned conventional process of regenerating LUTs is carried out, for example, after power to the image forming apparatus is turned on or after a long period of no use. For this reason, there is a problem in that image forming processes cannot be carried out during the process of regenerating LUTs, which undesirably generates so-called wait times.

SUMMARY OF THE INVENTION

The present invention has been devised to address the aforementioned problem, and it is an object thereof to provide an image forming apparatus and a control method thereof that reduces the wait times for image forming that are generated when modifying tables for gradation characteristic corrections.

According to the aspect of the present invention, there is provided an image forming apparatus that uses a table generated in advance to correct a gradation characteristic of an image to be formed when carrying out image forming using an image carrier, comprising: a patch forming unit configured to form a patch in an area where an image is not formed on the image carrier; a measuring unit configured to measure a density of the patch formed on the image carrier; and a modifying unit configured to modify the table based on the density of the patch measured by the measuring unit, wherein the patch forming unit forms the patch concurrent with image forming to the image carrier.

Further features of the present invention will become apparent from the following description of exemplary embodiments with reference to the attached drawings.

DESCRIPTION OF THE EMBODIMENTS

Various exemplary embodiments, features, and aspects of the present invention will be described in detail below with reference to the drawings.

First Embodiment

System Configuration

Figure 1:
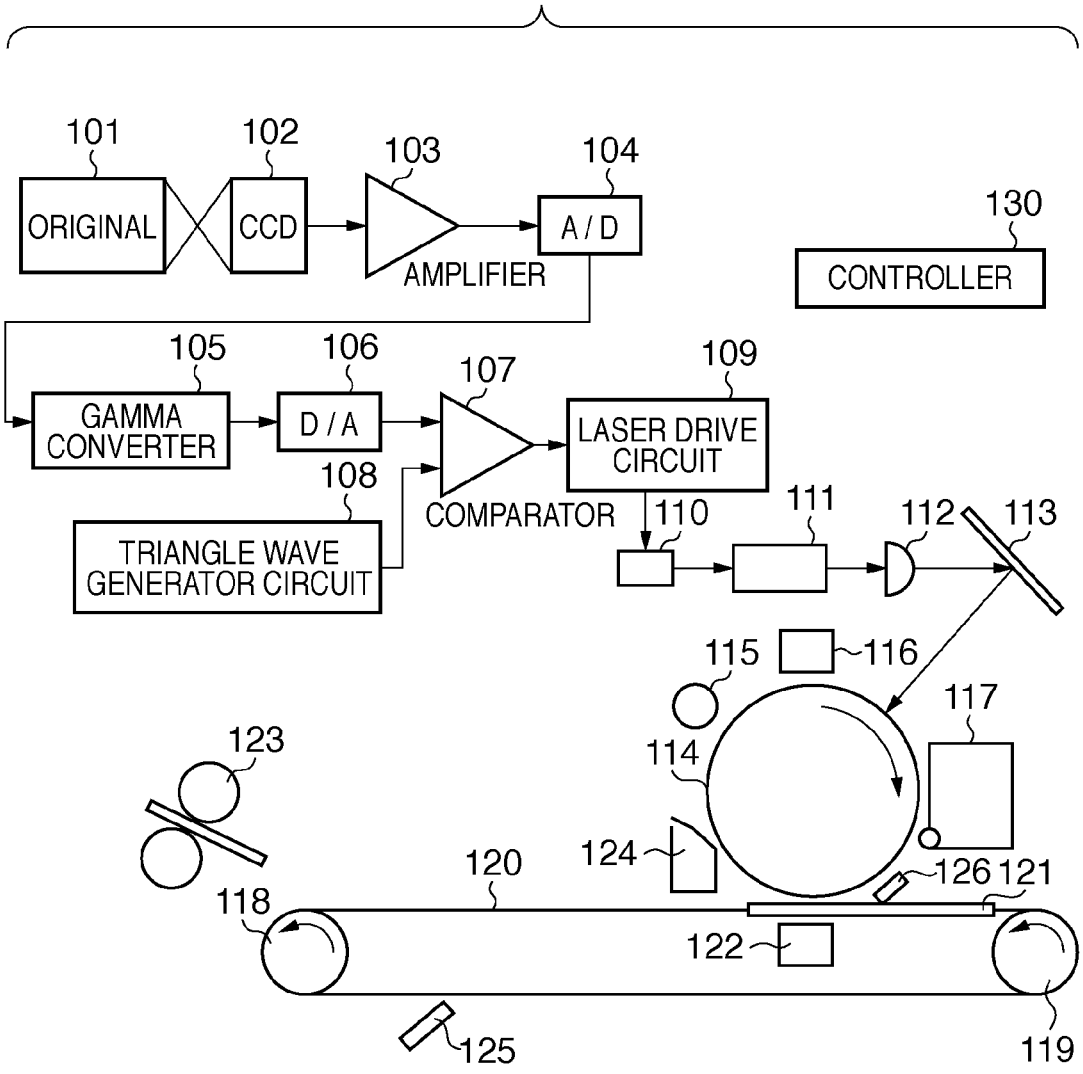
FIG. 1 is a block diagram showing an example system configuration of an image forming apparatus according to one embodiment of the present invention.

FIG. 1 is a block diagram showing an example system configuration of electrophotographic method digital multifunctional peripheral according to the present embodiment.

First, an image of an original 101 is read by a CCD 102 through an imaging lens. The CCD 102 separates the image into a multitude of pixels and generates photo-electric conversion signals corresponding to a density of each pixel. Thus-obtained analog image signals are amplified to a predetermined level by an amplifier 103, then converted to digital image signals of, for example, 8 bits (255 gradations) by an analog-to-digital converter (A/D converter) 104.

Next, the digital image signals are supplied to a gamma converter 105 and undergo gamma correction. The gamma converter 105 of the present embodiment carries out density conversion using a lookup table (LUT) system constituted by data of 256 bytes. That is, the gamma converter 105 holds in advance a LUT for density conversion and, in the present embodiment, is characterized by regenerating this LUT in order to respond to changes over time.

The digital image signals converted by the gamma converter 105 are input to a digital-to-analog converter (D/A converter) 106 where they are converted again to analog image signals, then supplied to one input of a comparator 107.

Triangle wave signals of a predetermined cycle generated from a triangle wave generator 108 are supplied to the other input of the comparator 107, and the previous analog image signals are compared against these triangle waves and undergo pulse width modulation. Binarized image signals that have undergone this pulse width modulation are input to a laser driver 109 and used as ON/OFF control signals for lighting a laser diode 110.

Laser light emitted from the laser diode 110 is scanned in a main scanning direction by a commonly known polygonal mirror 111, then irradiated via an f-theta lens 112 and a reflector mirror 113 onto a photosensitive drum 114, which is an image carrier that is rotated in a direction shown by an arrow in FIG. 1. After being uniformly neutralized by an exposure device 115, the photosensitive drum 114 is uniformly charged, negatively for example, by a primary charger 116. By receiving the irradiation of the aforementioned laser light in this state, an electrostatic latent image is formed corresponding to the image signals.

The electrostatic latent image formed on the photosensitive drum 114 is developed by a developer 117, thereby obtaining a visible image (toner image). At this time, a DC bias component corresponding to forming conditions of the electrostatic latent image and an AC bias component for improving development efficiency are superimposed and applied to the developer 117.

The toner image that has been developed on the photosensitive drum 114 is transferred by an effect of a transfer charger 122 onto a transfer material 121, which is held on a belt-shaped transfer material carrier (transfer belt) 120 that is tensioned between two rollers 118 and 119 and is continuously driven in a direction shown by an arrow in FIG. 1. After being transferred, the transfer material 121 has the image thereon fixed by passing through a fixing unit 123, and is then discharged outside.

Residual toner that remains on the photosensitive drum 114 after transfer is scraped away and collected by a cleaner 124. Furthermore, residual toner on the transfer belt 120 that remains after being separated from the transfer material 121 is scraped away by a cleaner 125 such as a blade installed on a periphery of the transfer belt 120 downstream of a position where the transfer material 121 is delivered to the fixing unit 123.

It should be noted that in FIG. 1, in order to simplify description, only a single image forming station is shown (including the photosensitive drum 114, the exposure device 115, the primary charger 116, and the developer 117). Ordinarily, in the case of a color image forming apparatus, a plurality of image forming stations corresponding to the colors of cyan, magenta, yellow, and black respectively for example are arranged in an array in order along a movement direction of the transfer belt 120. Furthermore, there are cases where a developer 117 of each color is also arranged in an array along the periphery of a single photosensitive drum 114. Furthermore, there are cases where a developer 117 of each color of yellow, magenta, cyan, and black is arranged in a rotatable casing. In this way, development of a desired color is carried out by causing a desired developer among the developers 117 corresponding to the plurality of colors to become in opposition to the photosensitive drum 114.

Further still, in order to correct development densities that have changed undesirably inside the developer 117 due to developing latent images, a patch sensor 126, which is a density detection unit, is provided on a surface of the photosensitive drum 114 in a position in the rotation direction thereof between the developer 117 and an opposing portion of the transfer belt 120. Densities of developer images for density detection (hereinafter referred to as patches), which have been developed on the photosensitive drum 114, are detected by the patch sensor 126, and the development densities, namely the amounts of developing agent, of the developer 117 are controlled so as to maintain the densities of the patches uniformly.

Figure 2:
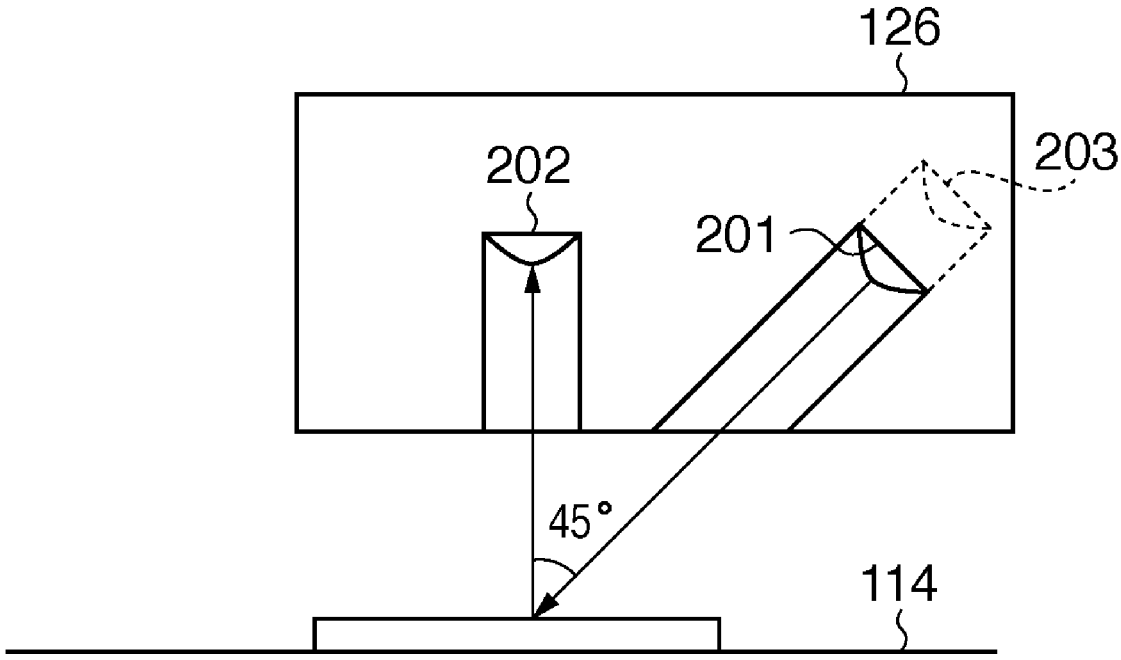
FIG. 2 is an outline cross-sectional view of a density sensor according to the present embodiment.

Here, FIG. 2 shows an example configuration of the patch sensor 126. The patch sensor 126 is constituted by a light source 201 such as an LED, a light-receiving element 202 for density measurements that receives reflected light when light from the light source 201 is irradiated onto the patches, and a light-receiving element 203 for light amount adjustments that directly receives an amount of light from the light source 201 in order to keep uniform the light amount of the light source 201.

In this way, the patch sensor 126 detects the developer densities of patch-shaped developer images for density detection (hereinafter referred to as patches) on which electrostatic latent images formed according to image signals for density control have been developed. Then, correction density signals are calculated based on a detection result thereof and, moreover, desired gradation characteristics are maintained in such a manner as the LUT of the gamma converter 105 may be freshly generated or corrections or the like based on the calculation results may be carried out.

The above-described series of operations is controlled by a controller 130 constituted by components such as a CPU, a ROM that stores a control program or the like, and a RAM that temporarily stores programs and data.

LUT Generation Processing

Next, detailed description is given regarding a process for modifying the LUT held in the gamma converter 105 according to the present embodiment.

Figure 3:
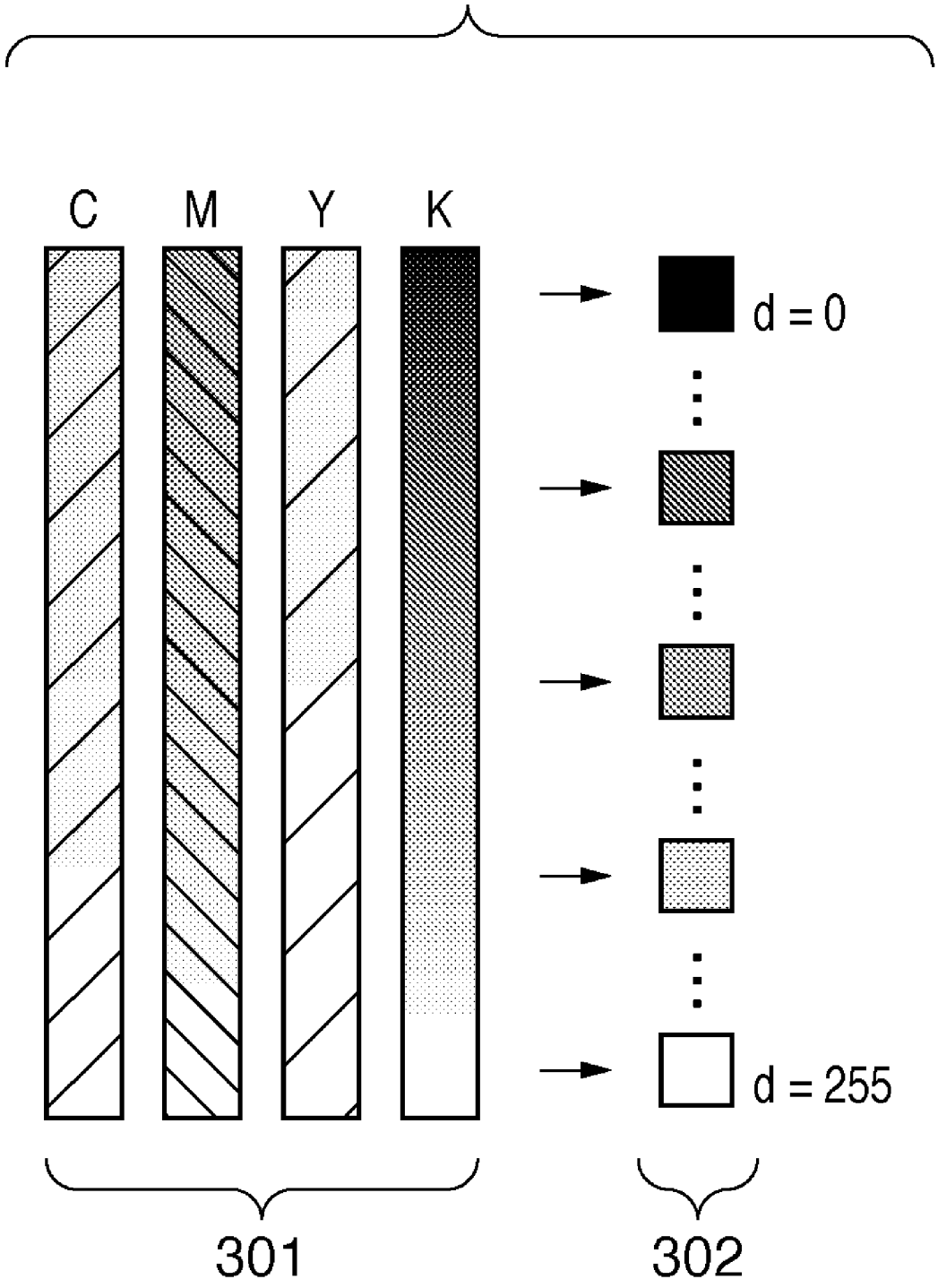
FIG. 3 is a schematic diagram of patches for LUT modification according to the present embodiment.

First, FIG. 3 shows a schematic diagram of patches that are necessary in the process for modifying the LUT. A patch group 301 for LUT modification shown in FIG. 3 is a collection of patches having varying density levels for each color of C, M, Y, and K. Numeral 302 indicates single patches that are the unit constituting the patch group 301 for LUT modification.

Figure 4:
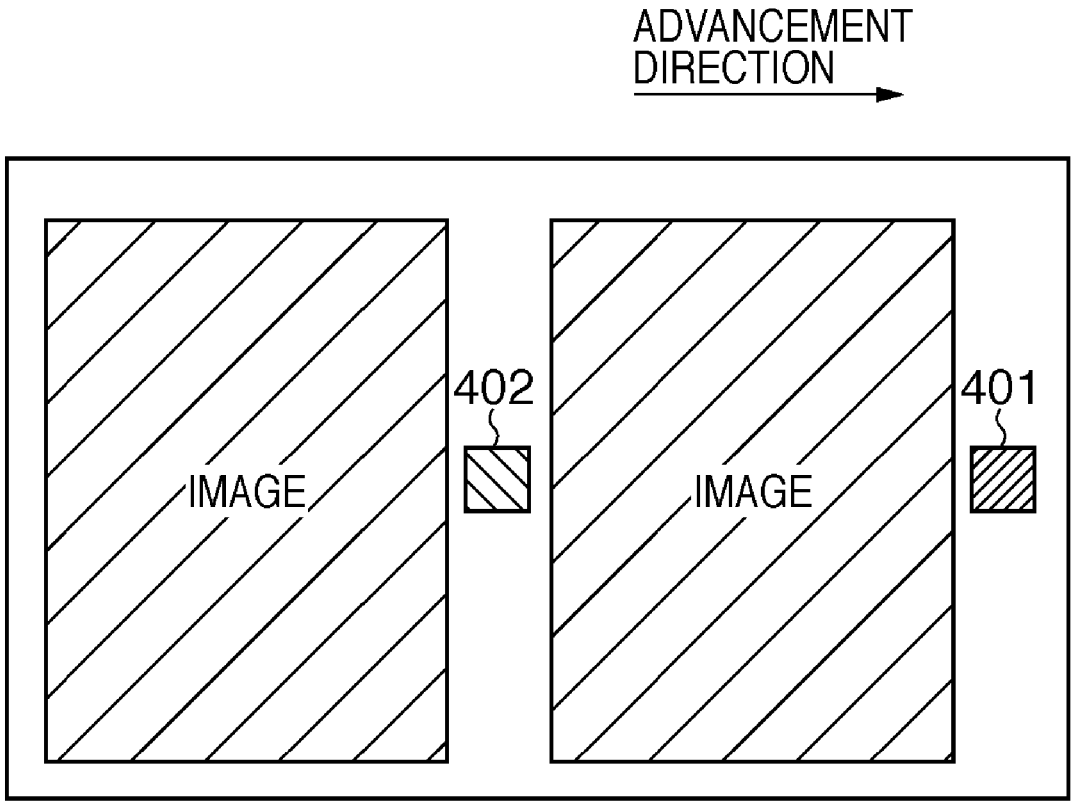
FIG. 4 is a diagram schematically showing how patch forming is processed in the present embodiment.

FIG. 4 schematically shows a relationship between input images on the photosensitive drum 114 and patches. The patches 302 shown in FIG. 3 are successively formed with varying density levels outside areas used in ordinary image forming on the surface of the photosensitive drum 114, that is, in an area where an image is not formed. For example, as shown in FIG. 4, the patches 302 are formed successively at positions of areas 401 and 402 known as inter-sheets (hereinafter, inter-sheet areas), which are between areas where images are formed on the photosensitive drum 114. In this way, in the present embodiment the patches 302 of a plurality of density levels are formed successively for each of the inter-sheet areas during image forming, and description is given later regarding the sequence of density levels.

The patch sensor 126 shown in FIG. 1 reads the densities of the patches 302, which are formed in the inter-sheet areas 401 and 402 (hereinafter referred to as inter-sheet patches 401 and 402) on the photosensitive drum 114. After this, although the image portions formed on the photosensitive drum 114 are transferred to the transfer material such as recording papers, the inter-sheet patches 401 and 402 are scraped away by the cleaner 124.

Figure 5:
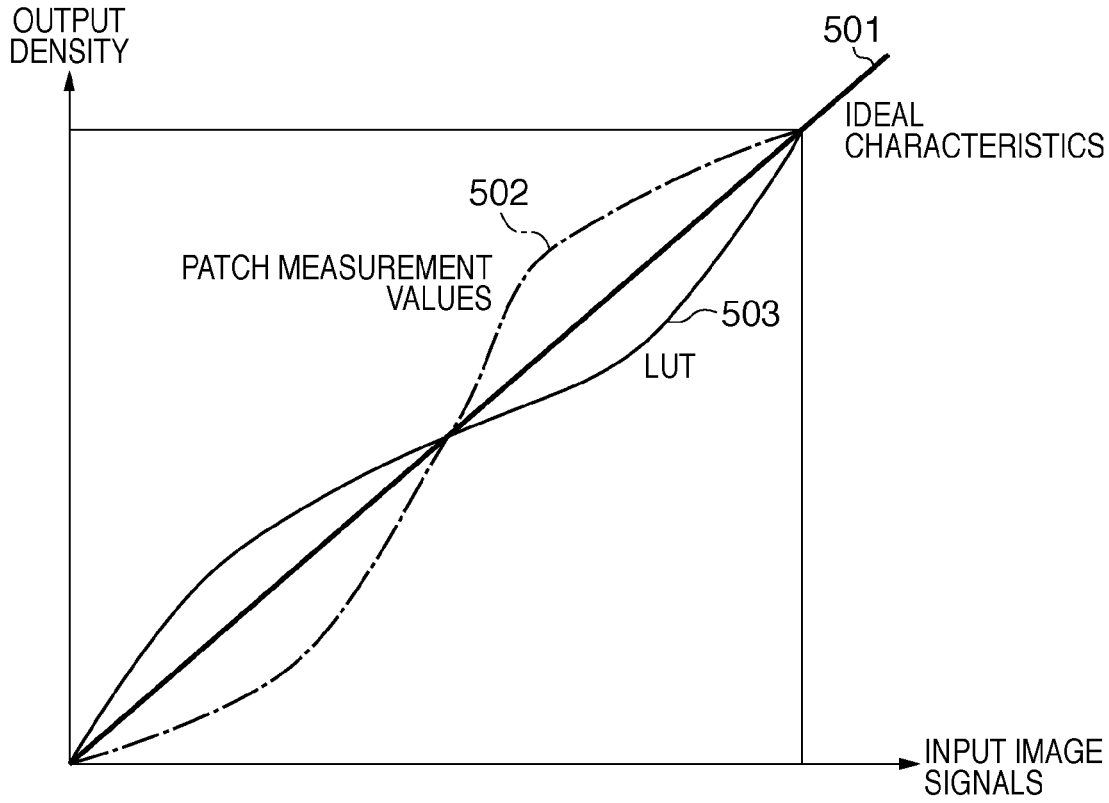
FIG. 5 is a diagram showing a LUT concept according to the present embodiment.

Here, FIG. 5 shows a relationship between density values obtained by measurements of inter-sheet patches and LUT characteristics according to the present embodiment. In FIG. 5, a curved line 501 indicates ideal gradation characteristics in which there is a linear relationship between the input image signals and the output densities. A curved line 502 is a curved line of characteristics obtained by measuring the inter-sheet patches. A curved line 503 is a curved line of characteristics of a LUT that has been modified based on measured values of the inter-sheet patches. By converting the input image signals using the LUT by causing the curved line 503 to have opposite characteristics to the curved line 502, it is possible to approach the curved line 501 of the ideal characteristics.

Figure 6:
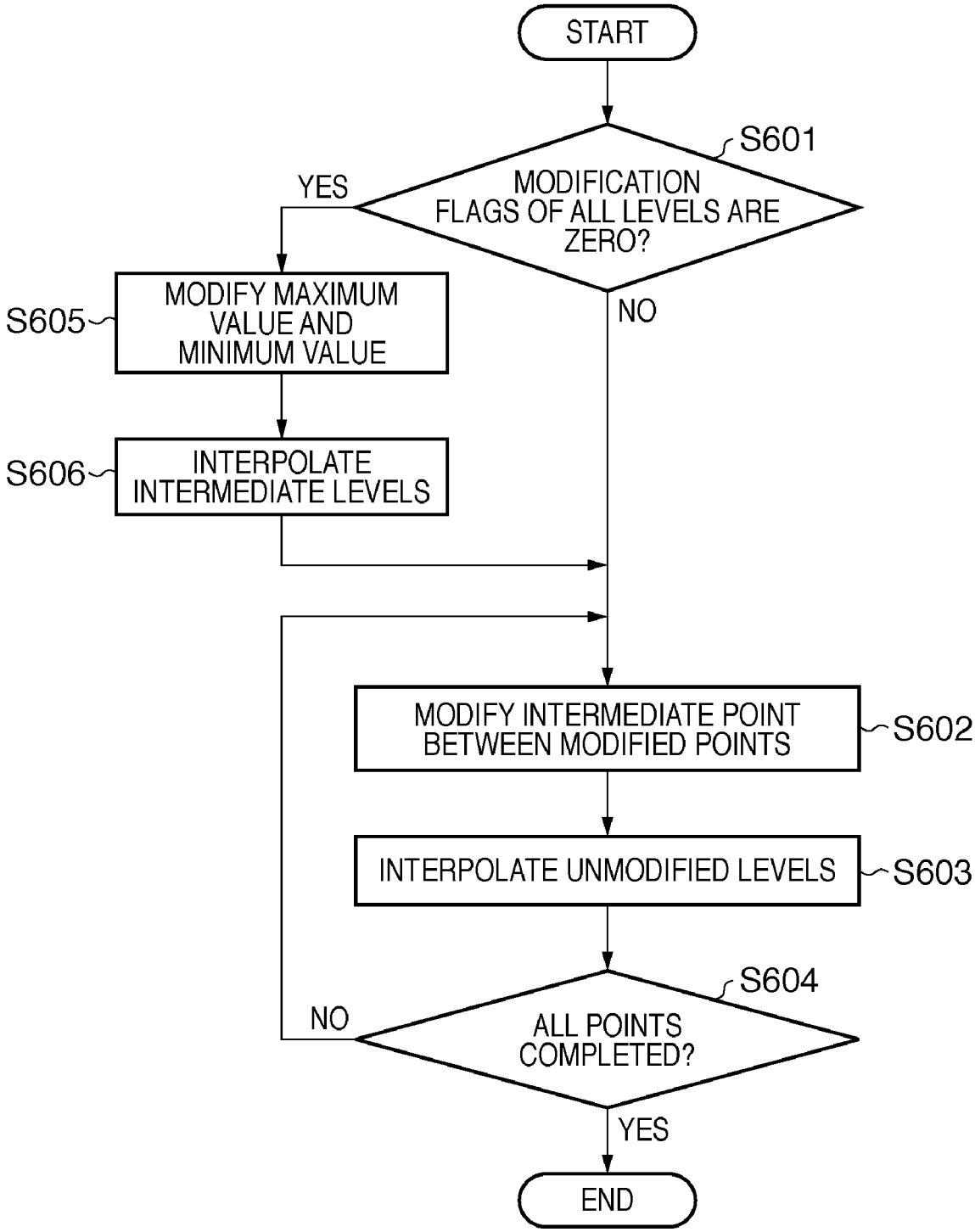
FIG. 6 is a flowchart showing a process for modifying a LUT according to the present embodiment.

FIG. 6 is a flowchart showing a process for modifying a LUT according to the present embodiment. Here, calculations involved in storing and modifying the LUT are carried out by the controller 130, image signals of 8 bits are input, and there are 256 levels in the LUT. The LUT according to the present embodiment holds a correction value Out_k (k indicates the level) to be output for each level and a modification flag Fk that indicates whether or not the correction value for that level has been modified according to a patch measurement within a predetermined period. Namely, Fk=0 indicates that the correction value Out_k has not been modified and Fk=1 indicates that the correction value Out_k has been modified. For example, immediately after power has been turned on to an image processing apparatus, all the levels will show Fk=0 since the LUT has not been modified for a long period. It should be noted that values expressing ideal characteristics in which the input/output relationship is linear, or values that have been modified previously may be used as the correction values Out_k in the LUT immediately after power is turned on.

Hereinafter, description is given of a flowchart in FIG. 6 in which the toner color is a single color in order to simplify description.

First, a determination is performed as to whether or not the modification flags Fk for all the levels of the LUT are zero (S601). In a case where all the levels are Fk=0, in addition to the output of the image to be formed, patches of a maximum level 255 and a minimum level 0 are generated and formed in the inter-sheet areas 401 and 402, and measured by the patch sensor 126. Then, based on the measured values of the two patches, output correction values Out_max and Out_min are modified for the maximum level and minimum level of the LUT and, moreover, modification flags Fmax and Fmin are overwritten to 1 (S605). Then, linear compression or linear expansion is carried out (S606) on correction values Out_mid of all intermediate levels in the LUT excluding the maximum level and the minimum level so as to keep these values in a range between Out_max and Out_min so that gradation inversion does not occur. This maintains a relationship between the correction values Out of all levels in the LUT.

Next, forming of an inter-sheet patch is carried out for a level that is precisely intermediate between the levels whose correction values have been modified, and the correction value of this intermediate level is modified based on a measured value thereof, then its modification flag is overwritten to 1 (S602). For example, in a case where the levels that have been modified through steps S605 and S606 are the two points of the maximum value 255 and the minimum value 0, then an inter-sheet patch is formed for the intermediate value 127 to modify the correction value Out_127, and the modification flag F127 is set to 1. It should be noted that in a case where the correction value Out_k that is modified in step S602 has produced gradation inversion with another already modified point (for example, a point where Fk+n=1), then it is necessary to limit the correction value Out_k using a clipping process or the like to a range in which gradation inversion does not occur. Also note that in this case, the value of Out_k+n may be modified by interpolating Out_k and another point.

Next, in the same manner as in step S606, a relationship between correction values between the modified levels is maintained (step S603) by executing linear conversion on unmodified levels, for which Fk=0, between modified levels, for which Fk=1, so that gradation inversion does not occur.

Then, finally, a determination is performed as to whether or not the modification flags Fk of all the levels have become 1. At step S604, if all the levels have become Fk=1, then processing finishes, but if there is a level remaining for which Fk=0, then the procedure returns to step S602 and processing continues, thereby carrying out correction for intermediate points between modified levels.

If, for example, at step S602 the already modified levels are the three points of 0, 127, and 255, then the levels 1 to 126 and 128 to 255 are unmodified (Fk=0). Accordingly, in this case, modification is successively carried out on the level 63 and level 191, which are the intermediate points between these unmodified levels. In this way, in a case where there are multiple levels as candidates for modification in the LUT, there is no particular limitation to the sequence of the processing for the multiple levels.

In this way, with the densities of inter-sheet patches according to the present embodiment, all gradations in the LUT are covered evenly by several initial points and the intervals between the patch densities gradually become narrower so as to give a lowest possible effect on image forming, which is carried out concurrently.

Gradation Correction Selection

The above-described flowchart shown in FIG. 6 refers to a process for correcting gradations for a single color. Accordingly, by carrying out this process for all colors, calibration is achieved for all colors. However, it is not absolutely necessary to carry out gradation corrections for all colors and improved efficiency in processing can be achieved by carrying out the gradation corrections selectively.

Hereinafter, an example is shown of selective performance in the gradation correction process according to the present embodiment.

The controller 130 analyzes the input image and performs control based on an analysis result thereof so that modifications of the LUT are not carried out for a toner color not used during image forming. Then, it determines a sequence for modifying the LUT in response to a toner usage ratio C:M:Y:K of the input image. For example, in a case where the toner usage ratio of the input image is C:M:Y:K=3:1:0:2, first no LUT modification is carried out for the Y color, then priority is given to carrying out LUT modification for the C color, and LUT modifications are carried out next for the K color, then for the M color after that. By controlling the colors targeted for LUT modification in response to the analysis result of the input image in this way, it becomes possible to carry out efficient calibrations corresponding to the input image.

Furthermore, it is also possible to obtain a toner color usage ratio by analyzing an entire input job and to determine a priority order for LUT modifications in response to that ratio. For example, in a case where the toner usage ratio of the input job is C:M:Y:K=3:1:0:2, first LUT modification is carried out based on 3×n (n is a predetermined positive integer) patches for the C color. After this, LUT modifications are carried out based on 2×n patches for the K color, then 1×n patches for the M color, thereby completing a first phase of gradation corrections. Then, modifications commence from LUT modifications of the C color again to commence a following second phase of LUT modifications. In this way, it is possible to perform calibration in response to a level of importance of the colors used.

It should be noted that by providing a selection unit enabling a user to select the gradation correction process, it is also possible to carry out calibrations according to a priority order of colors desired by the user.

Furthermore, in the present embodiment, an example was shown in which modifications were performed evenly between all gradations for the LUTs of all colors, but it is also effective to enable important colors and important gradation levels to be specified in advance. In this case, namely, by predominantly modifying portions corresponding to the specified levels in the LUT, output is possible in which specified colors are given priority and stabilized.

With the above-described present embodiment, it is possible to modify the LUT concurrent with image forming processes by forming inter-sheet patches on the photosensitive drum 114 each time image forming is performed. For this reason, no wait times are generated for LUT modification after power is turned on to the image forming apparatus or between output of images as is the case conventionally. Furthermore, since updating of the LUT can always be carried out for each output of an image, it is possible to suppress fluctuation in output gradation characteristics that occur over time and to maintain excellent output.

It should be noted that in the present embodiment, an example was shown in which the number of grids in the LUT was the same as the number of input gradations, but it is possible to achieve an equivalent effect using interpolation in a case where the number of levels is different from the number of input gradations.

Furthermore, in the present embodiment, an example was shown in which intermediate points were obtained by linear compression or expansion, but it is also possible to newly generate the intermediate points by carrying out linear interpolation or spline interpolation or the like.

Furthermore, in the present embodiment, an example was shown in which there was no limitation to the order of levels for which LUT modification processing was carried out, but it is also effective to perform corrections concentrating on points having a large degree of deviation before and after modification, that is, points having a large amount of modification.

Furthermore, in the present embodiment, an example was shown in which LUT modification processing was carried out color by color, but it is also possible to carry out LUT modification processing for the colors concurrently.

Furthermore, in the present embodiment, since LUT modification processing is carried out concurrent with image output, there is a possibility that the accuracy of gradation corrections will worsen undesirably in regard to several initial images formed immediately after power is turned on. An equivalent effect as in conventional gradation corrections can be achieved for this by performing control such that the processing of several initial points in LUT modification processing is carried out immediately after power is turned on, before outputting images.

Other Embodiments

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention can be implemented by a computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or script data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a storage medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-048823, filed Feb. 28, 2008, which is hereby incorporated by reference herein in its entirety.

What is claimed is:

1. An image forming apparatus that uses a table generated in advance to correct a gradation characteristic of an image to be formed when carrying out image forming using an image carrier, comprising:

a patch forming unit configured to form a patch in an area where the image is not formed on the image carrier;

a measuring unit configured to measure a density of the patch formed on the image carrier;

a modifying unit configured to modify the table based on the density of the patch measured by the measuring unit; and an analysis unit configured to analyze the image to be formed, wherein the patch forming unit controls colors targeted for patch forming in response to an analysis result of the analysis unit, and wherein the patch forming unit forms the patch concurrently with image forming of the image on the image carrier.

2. The image forming apparatus according to claim 1, wherein the patch forming unit forms the patch between areas where images are formed on the image carrier.

3. The image forming apparatus according to claim 2, wherein the patch forming unit successively forms patches of a plurality of densities between the areas where images are formed on the image carrier each time images are formed.

4. The image forming apparatus according to claim 3, wherein the patch forming unit successively forms the patches of the plurality of densities such that there are uniform intervals between all gradations in the table.

5. The image forming apparatus according to claim 4, wherein the patch forming unit successively forms the patches of the plurality of densities such that uniform intervals between all gradations in the table gradually become narrower.

6. The image forming apparatus according to claim 3, wherein the patch forming unit successively forms the patches of the plurality of densities based on a degree of deviation before and after modifications in the table that has been modified by the modifying unit.

7. A non-transitory computer-readable storage medium on which is stored a program for causing a computer to function as the image forming apparatus according to claim 1.

8. A control method of an image forming apparatus that carries out image forming using an image carrier, the method using a table generated in advance to correct a gradation characteristic of an image to be formed, and the method comprising:

a patch forming step of forming a patch in an area where the image is not formed on the image carrier;

a measuring step of measuring a density of the patch formed on the image carrier; and a modifying step of modifying the table based on the density of the patch measured in the measuring step; and an analyzing step of analyzing the image to be formed, wherein the patch forming step controls colors targeted for patch forming in response to an analysis result of the analyzing step, and wherein in the patch forming step, the patch is formed concurrently with image forming of the image on the image carrier.

9. The control method of an image forming apparatus according to claim 8, wherein in the patch forming step, the patch is formed between areas where images are formed on the image carrier.

10. The control method of an image forming apparatus according to claim 9, wherein in patch forming step, patches of a plurality of densities are successively formed between the areas where images are formed on the image carrier each time images are formed.

* * * * *